US011390418B2

(12) United States Patent
Neal

(10) Patent No.: US 11,390,418 B2
(45) Date of Patent: Jul. 19, 2022

(54) FOLDABLE CASE

(71) Applicant: Instacake Cards Inc., Lantzville (CA)

(72) Inventor: Sarah Neal, Lantzville (CA)

(73) Assignee: Instacake Cards Inc., Lantzville (CA)

( * ) Notice: Subject to any disclaimer, the term of this patent is extended or adjusted under 35 U.S.C. 154(b) by 50 days.

(21) Appl. No.: 16/805,536

(22) Filed: Feb. 28, 2020

(65) Prior Publication Data

US 2021/0269190 A1 Sep. 2, 2021

(51) Int. Cl.

| | |
|---|---|
| ***B65D 5/36*** | (2006.01) |
| ***B65D 5/28*** | (2006.01) |
| ***B31B 50/14*** | (2017.01) |
| ***B31B 50/26*** | (2017.01) |
| ***B31B 50/25*** | (2017.01) |
| *B31B 120/30* | (2017.01) |
| *B31B 100/00* | (2017.01) |

(52) U.S. Cl.

CPC ..... *B65D 5/3678* (2013.01); *B31B 50/14* (2017.08); *B31B 50/25* (2017.08); *B31B 50/26* (2017.08); *B65D 5/28* (2013.01); *B31B 2100/0024* (2017.08); *B31B 2120/302* (2017.08)

(58) Field of Classification Search

CPC ..... B65D 5/3678; B65D 5/28; B65D 5/36; B65D 5/3635; B65D 5/563; B65D 5/3628; B65D 1/225; B65D 5/008; B65D 5/20

USPC ..... 229/117.05, 117.01, 117.06, 113, 114, 229/5.84; 206/183; 220/23.86

See application file for complete search history.

(56) References Cited

U.S. PATENT DOCUMENTS

| | | | | |
|---|---|---|---|---|
| 1,700,758 | A * | 2/1929 | Berkowitz | B65D 5/4612 229/117.05 |
| 2,460,108 | A * | 1/1949 | Smith | B65D 71/0077 206/179 |
| 5,203,491 | A * | 4/1993 | Marx | A21B 3/131 220/573.1 |
| 11,053,048 | B2 * | 7/2021 | Sollie | B65D 5/2057 |
| 2010/0133329 | A1 * | 6/2010 | Dickie | B65D 5/746 229/117.01 |

* cited by examiner

*Primary Examiner* — Christopher R Demeree

(74) *Attorney, Agent, or Firm* — Oyen Wiggs Green & Mutala LLP

(57) ABSTRACT

A foldable case and method of making same are disclosed. The foldable case is collapsible between a closed position and an open position without needing to re-fold the sheet of material. The foldable case is made of a sheet of material. The sheet of material has a central portion, opposing first and second portions, and opposing third and fourth portions. First and second portions adjoin a length of respective top and bottom edges of the central portion. Third and fourth portions adjoin a length of respective left and right edges of central portion. A number of folding lines are provided on the sheet of material. The foldable case can be made by folding along the folding lines and adhering first and second portions to the third and fourth portions so as to form a case in the folded configuration.

8 Claims, 6 Drawing Sheets

FOLDABLE CASE

TECHNICAL FIELD

This application relates to foldable cases, and methods of making same.

BACKGROUND

Conventional foldable paper cases are typically either in a folded or an unfolded configuration. They are not collapsible between an open position for holding materials and a closed position for storage. Collapsing a conventional folded paper case typically results in disassembling the case to an unfolded sheet of paper. An adhesive means would be required to return the paper case to the folded configuration.

There is a general desire for a foldable case that is easily collapsible between an open position and a closed position without having to disassemble the case to an unfolded configuration, and more particularly, a collapsible foldable case that can be used for cooking or baking.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a foldable case. The foldable case is collapsible between an open position and a closed position. The foldable case comprises a sheet of material. The sheet of material has a central portion, opposing first and second portions, and opposing third and fourth portions. First and second portions adjoin a length of respective top and bottom edges of the central portion. Third and fourth portions adjoin a length of respective left and right edges of the central portion.

The sheet of material has a number of folding lines, including: a first folding line separating the first and central portions; a second folding line separating the second and central portions; a third folding line separating the third and central portions; a fourth folding line separating the fourth and central portions; a fifth folding line extending lengthwise from a terminal end of the third portion to a terminal end of the fourth portion; a sixth folding line extending diagonally from a first point at the top edge or the left edge to a second point at the bottom edge or the right edge of the central portion; and a seventh folding line extending diagonally from a third point at the top edge or the right edge to a fourth point at the bottom edge or the left edge of the central portion.

In some embodiments, the sheet of material has opposing first and second connecting flaps adjoining a length of respective left and right edges of the first portion, and opposing third and fourth connecting flaps adjoining a length of respective left and right edges of the second portion. The first, second, third and fourth connecting flaps may be arranged to adhere first and second portions to the third and fourth portions.

One aspect of the invention provides methods for making foldable case. The method involves folding the sheet of material along first, second, third, fourth, fifth, sixth, and seventh folding lines to form creases, and adhering first and second portions to the third and fourth portions. In some embodiments, the method involves adhering the first and third connecting flaps to a surface of the third portion, and adhering the second and fourth connecting flaps to a surface of the fourth portion.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

An aspect of the invention relates to a foldable case. The foldable case is collapsible between an open position for holding materials and a closed position for storage without needing to disassemble the case into an unfolded configuration. The foldable case is substantially flat in the closed position. The foldable case may be collapsed and opened using a respective single folding and unfolding action. The foldable case may be made of heat-resistant paper. In an example embodiment, one or more food ingredients (e.g. baking ingredients) are loaded into the foldable case when the case is in its open position. The ingredients may be mixed in the foldable case. The ingredient-loaded foldable case may be loaded in a microwave or conventional oven to cook the ingredients to produce a finished food product.

Figure 1:
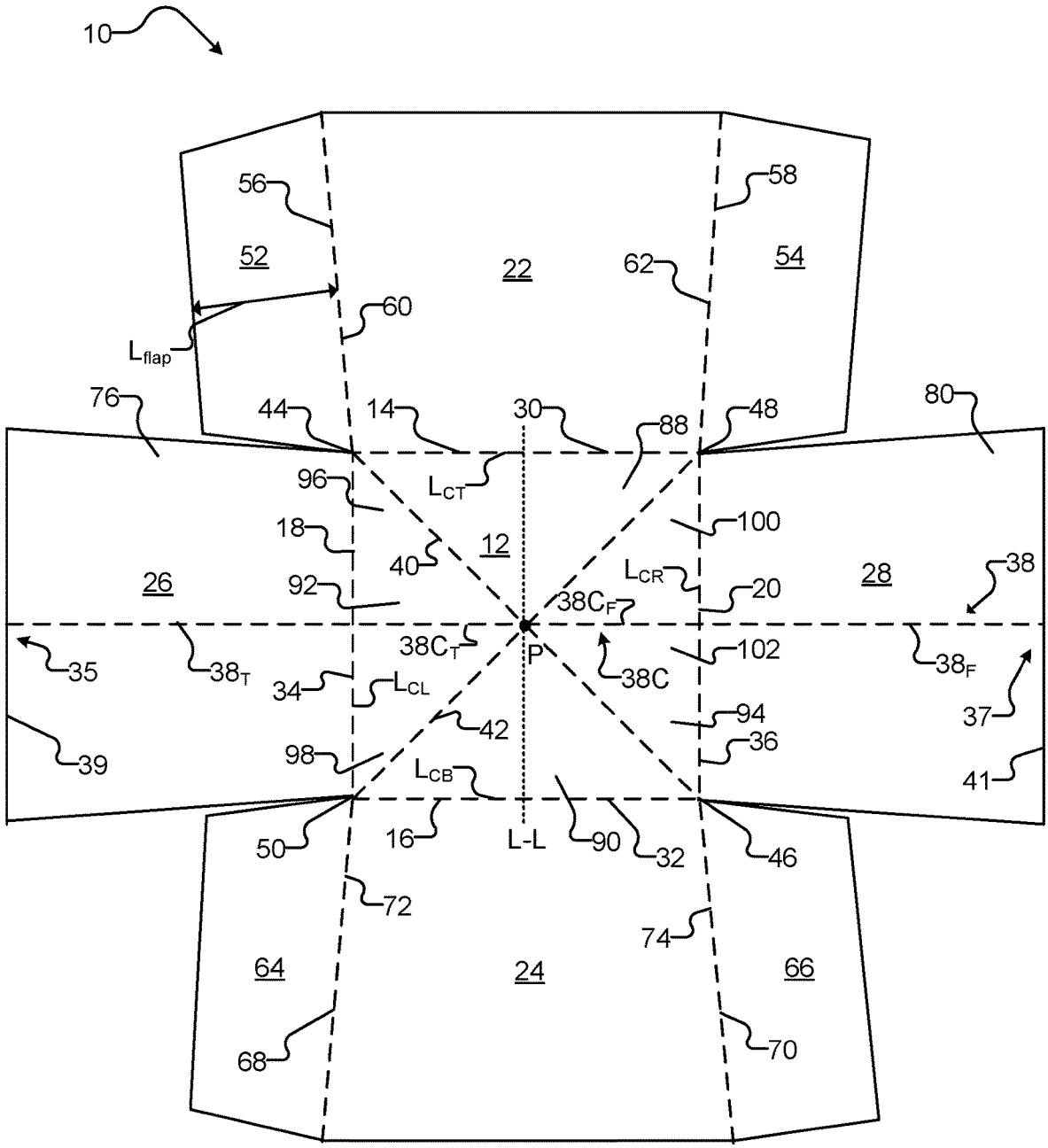
FIG. 1 is a top plan view of a foldable case in an unfolded configuration.

FIG. 1 is a top plan view of a foldable case in an unfolded configuration according to an example embodiment. Foldable case 10 has a central portion 12. Central portion 12 has a top edge 14, an opposing bottom edge 16, a left edge 18 and a right edge 20. Left 18 and right edges 20 each extends from top edge 14 to bottom edge 16. The lengths of top edge 14, bottom edge 16, left edge 18 and right edge 20 are denoted as $L_{CT}$, $L_{CB}$, $L_{CL}$ and $L_{CR}$ respectively.

A first portion 22, a second portion 24, a third portion 26 and a fourth portion 28 may adjoin central portion 12 at a length of top edge 14, bottom edge 16, left edge 18 and right edge 20 respectively. In the illustrated embodiments, first 22, second 24, third 26 and fourth portions 28 each adjoin a full length $L_{CT}$, $L_{CB}$, $L_{CL}$ and $L_{CR}$ of top, bottom, left and right edges 14, 16, 18, 20. This is not mandatory; however. First, second, third and fourth portions 22, 24, 26, 28 may adjoin central portion 12 at a partial length $L_{CT}$, $L_{CB}$, $L_{CL}$ and $L_{CR}$. Central 12, first 22, second 24, third 26 and fourth 28 portions may be a unitary sheet of material.

A first folding line 30 separates first portion 22 from central portion 12. First folding line 30 may coincide with top edge 14. A second folding line 32 separates second portion 24 from central portion 12. Second folding line 32 may coincide with bottom edge 16. A third folding line 34 separates third portion 26 from central portion 12. Third folding line 34 may coincide with left edge 18. A fourth folding line 36 separates fourth portion 28 from central portion 12. Fourth folding line 38 may coincide with right edge 20.

A fifth folding line 38 may extend lengthwise across third portion 26, central portion 12 and fourth portion 38 from a terminal end 35 of third portion 26 to a terminal end 37 of fourth portion 28. Terminal ends 35, 37 of third 26 and fourth 28 portions are opposite to one another and are positioned at a point along respective left 39 and right 41 edges of third 26 and fourth 28 portions. Fifth folding line 38 may be separated into fifth folding line 38T, fifth folding line 38C and fifth folding line 38F to define the fifth folding line 38 which extends lengthwise across the respective third portion 26, central portion 12, and fourth portion 28.

A sixth folding line 40 and a seventh folding line 42 may extend diagonally across central portion 12 to intersect at a point P. For sake of reference, an imaginary line L-L is provided on FIG. 1. Imaginary line L-L extends parallel to left and right edges 18, 20 and intersects top and bottom edges 14, 16 at the midpoints of lengths $L_{CT}$ and $L_{CB}$ (i.e. $L_{CT}/2$, $L_{CB}/2$). Point P may or may not be positioned along imaginary line L-L. In some embodiments point P is positioned at a midpoint along imaginary line L-L (i.e. at L-L/2). In some embodiments fifth folding line 38 intersects sixth and seventh folding lines 40, 42 at point P.

Sixth folding line 40 may extend diagonally from a point along top edge 14 or left edge 18 to a point along bottom edge 16 or right edge 20. Seventh folding line 42 may extend diagonally from a point along top edge 14 or right edge 20 to bottom edge 16 or left edge 18. In some embodiments sixth folding line 40 extends diagonally from a top left corner 44 to a bottom right corner 46 of central portion 12. In some embodiments seventh folding line 42 extends diagonally from a top right corner 48 to a bottom left corner 50 of central portion 12. In such embodiments point P is located at substantially a midpoint along imaginary line L-L. In some embodiments a mirror image of the folding lines in central portion 12 is generated when taken along imaginary line L-L.

Sixth folding line 40 and seventh folding line 42 separate fifth folding line 38C into fifth folding lines 38$C_T$, 38$C_F$. Fifth folding line 38$C_T$ is the line adjoining fifth folding line 38T and fifth folding lines 38$C_F$ is the line adjoining fifth folding line 38F. In some embodiments, fifth folding line 38 intersects at substantially midpoint along lengths $L_{CL}$ and $L_{CR}$ of central portion 12 (i.e. $L_{CL}/2$, $L_{CR}/2$). Fifth folding line 38 may however intersect at any point along lengths $L_{CL}$ and $L_{CR}$ of central portion 12.

The folding lines (fifth folding line 38C, sixth folding line 40 and seventh folding line 42) divide central portion 12 into six sections. Sixth 40 and seventh 42 folding lines divide central portion 12 into a first section 88, a second section 90 opposite to first section 88, a third section 92 between first 88 and second 90 sections and a fourth section 94 opposite to third section 92. Fifth folding line 38C further divides third 92 and fourth 94 sections into respective fifth 96 and sixth 98 sections, and seventh 100 and eighth 102 sections. In some embodiments first 88, second 90, third 92, and fourth 94 sections have substantially the same shape and size (i.e. substantially equal length and height or radius), and fifth 96, sixth 98, seventh 100 and eighth 102 sections have substantially the same shape and size. In such embodiments the sizes of fifth 96, sixth 98, seventh 100 and eighth 102 sections are smaller than the sizes of first 88, second 90, third 92, and fourth 94 sections. In some embodiments first 88, second 90, third 92, and fourth 94 sections have different shapes and sizes.

In the illustrated embodiments first 88, second 90, third 92, fourth 94, fifth 96, sixth 98, seventh 100 and eighth 102 sections (collectively, sections 88, 90, 92, 94, 96, 98, 100, 102) each has a triangular shape. This is not mandatory. Sections 88, 90, 92, 94, 96, 98, 100, 102 can be any other suitable shapes, including but not limited to polygons, curved shapes, etc.

In some embodiments a first connecting flap 52 and an opposing second connecting flap 54 optionally adjoin respective left and right opposing edges 56, 58 of first portion 22. In such embodiments an eighth folding line 60 separates first connecting flap 52 from first portion 22, and a ninth folding line 62 separates second connecting flap 54 from first portion 22. Eighth folding line 60 may coincide with left edge 56 of first portion 22. Ninth folding line 62 may coincide with right edge 58 of first portion 22.

In some embodiments a third connecting flap 64 and an opposing fourth connecting flap 66 optionally adjoin respective left and right opposing edges 68, 70 of second portion 24. In such embodiments a tenth folding line 72 separates third connecting flap 64 from second portion 24, and an eleventh folding line 74 separates fourth connecting flap 66 from second portion 24. Tenth folding line 72 may coincide with left edge 68 of second portion 24. Eleventh folding line 74 may coincide with right edge 70 of second portion 24.

First 52 and third 64 connecting flaps are adhesable to an inner 76 or outer surface (not shown) of third portion 26. Second 54 and fourth 66 connecting flaps are adhesable to an inner 80 or outer surface 82 of fourth portion 28. In the illustrated embodiments connecting flaps 52, 64 are provided to connect first 22 and second 24 portions to third portion 26, and connecting flaps 54, 66 are provided to connect first 22 and second 24 portions to fourth portion 28. Connecting flaps 52, 54, 64, 66 are optional. First 22 and second 24 portions may be connected to third 26 and fourth 28 portions by any other suitable means (e.g. using an adhesive means to adhere left edges 56, 58 of the respective first 22 and second 24 portions to the opposing edges of third portion 26, and to adhere right edges 58, 70 of the respective first 22 and second 24 portions to the opposing edges of fourth portion 28).

In some embodiments central, first, second, third and fourth portions 12, 22, 24, 26, 28 (collectively referred to hereinafter as portions 12, 22, 24, 26, 28) each has a quadrilateral shape (i.e. any polygon with four edges and four vertices such as square, rectangle, parallelogram, rhombus, kite, parallelogram, trapezoid, etc.). In the illustrated embodiments central portion 12 has a square shape, and each of first 22, second 24, third 26 and fourth 28 portions has a trapezoid shape. Portions 12, 22, 24, 26, 28 may, however, be any suitable two-dimensional shape. For example, portions 12, 22, 24, 26, 28 may be any polygons (i.e. shapes made with straight lines such as triangles, quadrilaterals, pentagons, hexagons, etc.) or curved shapes (e.g. circle, semi-circle, ellipses, etc.). Portions 12, 22, 24, 26, 28 may have the same shape as each another or have different shapes from one another.

The size (e.g. lengths, heights and radius) of first 22, second 24, third 26 and fourth 28 portions may be the same. In some embodiments the size of first 22 and second 24 portions are the same as one another but are different from the size of third 26 and fourth 28 portions.

Optional first, second, third and fourth connecting flaps 52, 54, 64, 66 (collectively, connecting flaps 52, 54, 64, 66) each has a shape suitable to facilitate connection between first 22 and second portions 24 and the respective third 26 and fourth 28 portions. In the illustrated embodiments connecting flaps 52, 54, 64, 66 each has a quadrilateral shape with a maximum length defined as $L_{flap}$. Length $L_{flap}$ may be less than half (½) of the length of third 26 or fourth 28 portion, including any lengths therebetween e.g. 1/20, 1/15, 1/10, 1/8, 1/6, 1/4, 1/3, etc.

Figure 2:
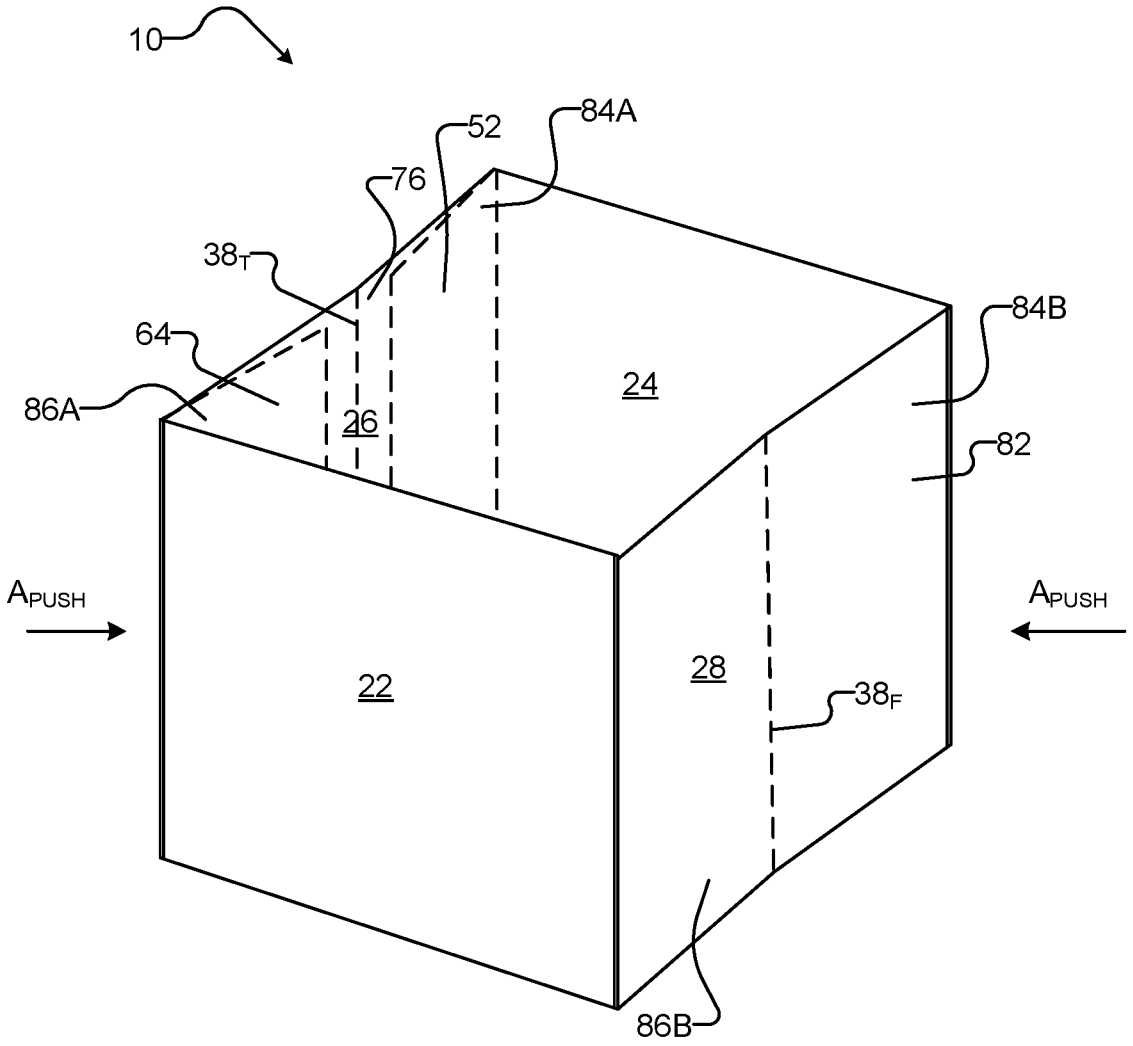
FIG. 2 is a perspective view of the FIG. 1 foldable case in a folded configuration, in an open position.
Figure 3:
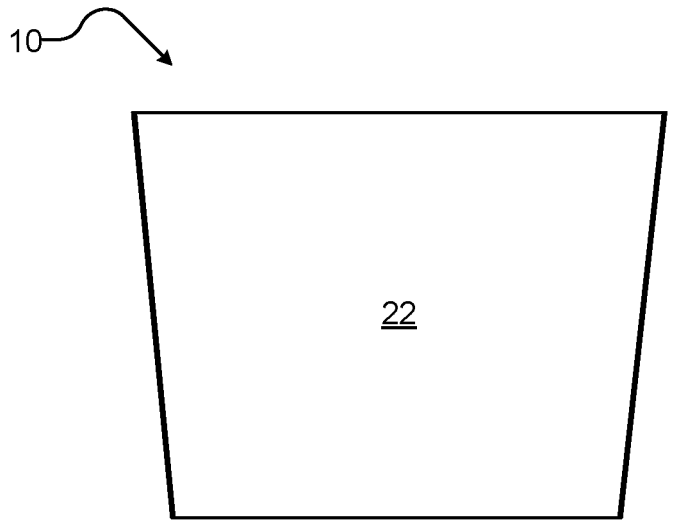
FIG. 3 is a front elevation view of the FIG. 2 foldable case.
Figure 4:
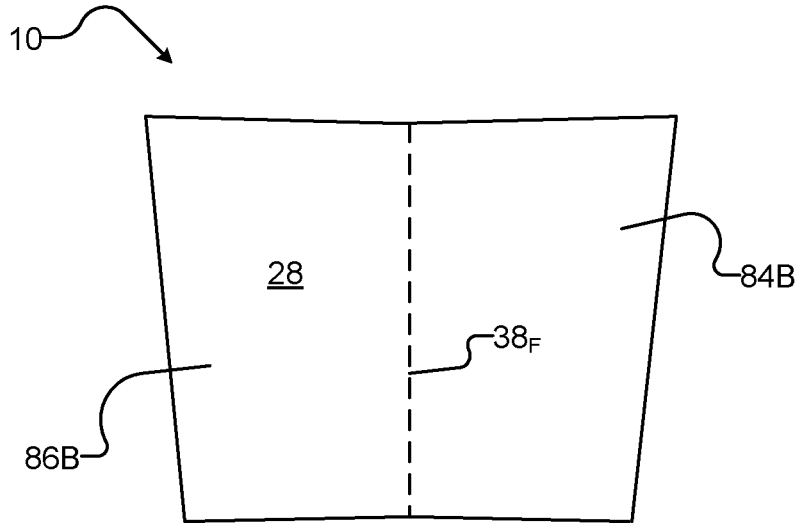
FIG. 4 is a side elevation view of the FIG. 2 foldable case.
Figure 5:
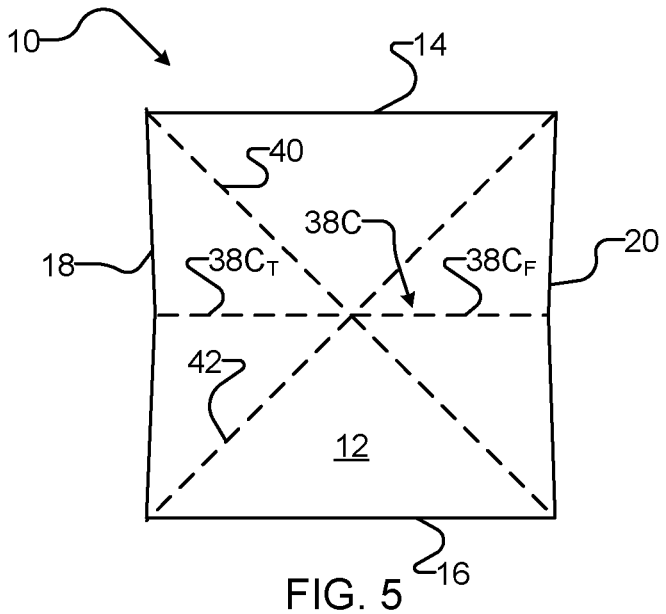
FIG. 5 is a bottom plan view of the FIG. 2 foldable case.
Figure 6:
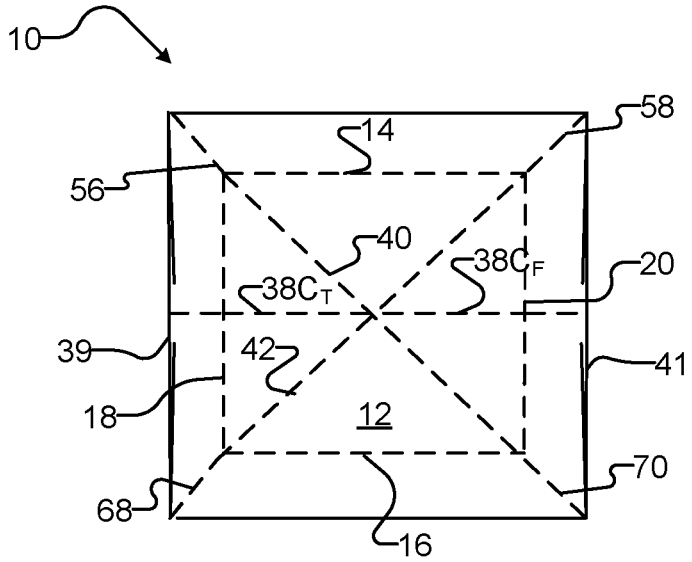
FIG. 6 is a top plan view of the FIG. 2 foldable case.
Figure 7:
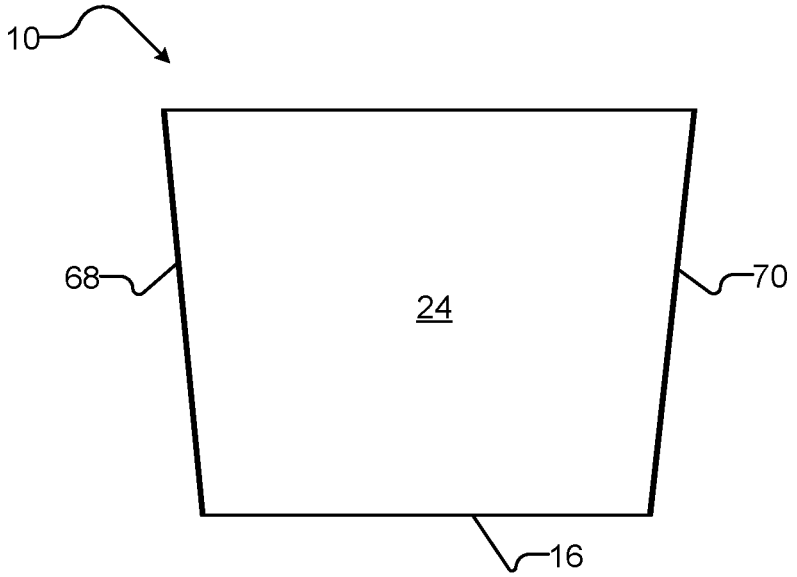
FIG. 7 is a top plan view of the FIG. 1 foldable case in a folded configuration, in a closed position.

An aspect of the invention relates to a method of making a foldable case. FIG. 2 is a perspective view of the foldable case in a folded configuration according to an example embodiment. FIGS. 3, 4, 5 and 6 show respective front elevation, side elevation, bottom plan and top plan views of the FIG. 2 foldable case. The folded case shown in FIG. 2 is assembled using the unfolded sheet of material shown in FIG. 1. Referring to both FIGS. 1 and 2, foldable case 10 may be assembled by folding along folding lines 30, 32, 34, 36, 38, 40, 42, and optionally folding lines 60, 62, 72, 74 in any suitable order to create crease lines. First 22 and second 24 portions are then connected to third 26 and fourth 28 portions. In embodiments in which connecting flaps 52, 54, 64, 66 are provided, connecting flaps 52, 64, 54, 66 are adhered to the surfaces 76, 78, 80, 82 of third 26 and fourth 28 portions respectively.

Foldable case 10 is collapsible between an open position and a closed configuration. The open position of foldable case 10 is the folded configuration as shown in FIGS. 2 to 6. In the open position, materials can be loaded into foldable case 10. FIGS. 7, 8, 9 and 10 show respective top plan, front elevation, rear elevation and side elevation views of the foldable case of FIG. 2 in the closed position.

Figure 8:
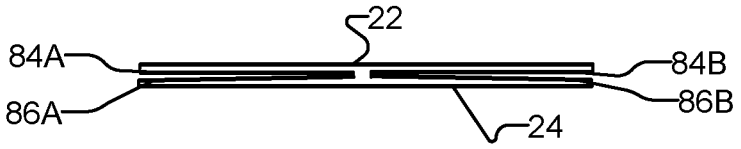
FIG. 8 is a front elevation view of the FIG. 7 foldable case.
Figure 9:
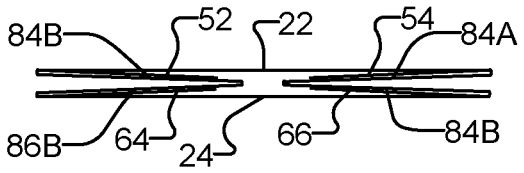
FIG. 9 is a rear elevation view of the FIG. 7 foldable case.
Figure 10:
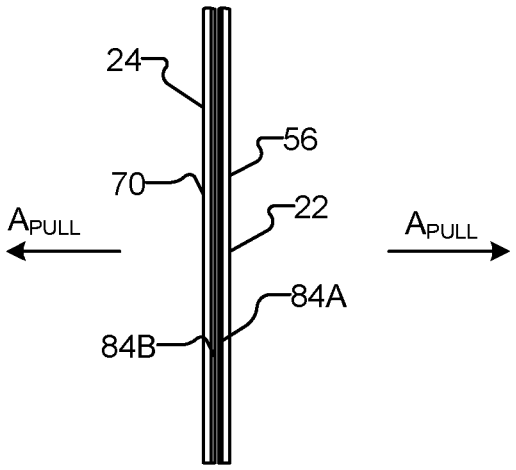
FIG. 10 is side elevation view of the FIG. 7 foldable case.

In some embodiments foldable case 10 is collapsible between the open and closed positions using a respective single unfolding action and folding action. In one embodiment to collapse foldable case 10 from the open position (e.g. FIG. 2) to the closed position (e.g. FIG. 8), a user may use one finger from each hand to push each of third 26 and fourth 28 portions at any point along fifth folding line $\mathbf{38}_T$, $\mathbf{38}_F$ towards one another (e.g., in the direction of the arrows $A_{PUSH}$ shown in FIG. 2). Third 26 and fourth 28 portions each form a first segment 84A,B and a second segment 86A,B. First 84A,B and second 86A,B segments formed by folding along the respective fifth folding lines $\mathbf{38}_T$, $\mathbf{38}_F$ of third 26 and fourth 28 portions overlap. The overlapping first 84A,B and second 86A,B segments are folded towards the respective fifth folding lines $\mathbf{38}C_T$, $\mathbf{38}C_F$ such that a region of fifth folding lines $\mathbf{38}_T$ and $\mathbf{38}_F$ touch the respective fifth folding lines $\mathbf{38}C_T$, $\mathbf{38}C_F$. First 88 and second 90 sections are folded into their respective shapes (i.e. triangles in the illustrated embodiments). First section 88 and the opposing second section 90 are opposite to each other and overlap. When folded, first 84A,B and second 86A,B segments are positioned between first 88 and second 90 sections. In the closed position, foldable case 10 is substantially flat, as best shown in FIGS. 8 and 10.

To open foldable case 10 from the closed position (e.g. FIG. 8) to the open positon (e.g. FIG. 2), a user can unfold all of fifth 38, sixth 40 and seventh 42 folding lines by one pulling action. In one embodiment a user may grasp opposing edges 56, 58, 68, 70 of first 22 and second 24 portions with each hand and pull first 22 and second 24 portions in a direction away from one another as shown with the arrows $A_{PULL}$ in FIG. 10.

The mechanisms of opening and closing foldable case 10 explained above are merely examples. It is understood that foldable case 10 can be opened and closed in any manner, and using as many pushing or pulling actions as the user requires.

Foldable case 10 may be constructed from a sheet of material. The sheet of material may be paper. In some embodiments the paper is suitable for cooking or baking, e.g., in a microwave or oven. The paper may be heat-resistant and/or moisture-resistant and/or grease-proof and/or have non-stick surfaces. The paper can be wax paper, baking paper, cellulose-based paper, parchment paper. The paper may have sufficient thickness and/or weight to hold the loaded materials (e.g., cooking or baking ingredients). In some embodiments the paper has a thickness in a range of between 0.05 mm to 0.50 mm, including any value therebetween e.g. 0.10, 0.15, 0.20, 0.25, 0.30, 0.35, 0.40, 0.45 mm etc. In some embodiments the paper has a thickness in a range of between 0.10 to 0.30 mm, including any value therebetween e.g. 0.12, 0.14, 0.16, 0.18, 0.20, 0.22, 0.24, 0.26, 0.28 mm, etc.

In some embodiments foldable case 10 may be used as a disposable baking container in which a cake mix can be placed when foldable case 10 is in the open position. The cake can be baked in foldable case 10 using a microwave or conventional oven.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof; elements which are integrally formed may be considered to be connected or coupled;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

While a number of exemplary aspects and embodiments are discussed herein, those of skill in the art will recognize certain modifications, permutations, additions and sub-combinations thereof.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. An open-top foldable case comprising a sheet of material, the sheet of material having:

a central portion having a top edge and an opposing bottom edge, and a left edge and an opposing right edge, the left and right edges each extending from the top edge to the bottom edge;

a first portion and an opposing second portion adjoining a length of the respective top and bottom edges of the central portion separated by respective first and second folding lines;

a third portion and an opposing fourth portion adjoining a length of the respective left and right edges of the central portion separated by respective third and fourth folding lines;

a fifth folding line extending lengthwise from a terminal end of the third portion to a terminal end of the fourth portion;

a sixth folding line extending diagonally from a first point at the top edge or the left edge to a second point at the bottom edge or the right edge of the central portion;

a seventh folding line extending diagonally from a third point at the top edge or the right edge to a fourth point at the bottom edge or the left edge of the central portion, wherein the fifth, sixth and seventh folding lines intersect at a midpoint of the central portion, wherein the folding case is collapsible between a closed position and an open position by respectively folding and unfolding along the fifth, sixth and seventh folding lines;

a first connecting flap and an opposing second connecting flap adjoining a length of respective left and right edges of the first portion separated by respective eighth and ninth folding lines; and a third connecting flap and an opposing fourth connecting flap adjoining a length of respective left and right edges of the second portion separated by respective tenth and eleventh folding lines, wherein the edges of the first and third connecting flaps are detached from the edges of the third portion, and the edges of the second and fourth connecting flaps are detached from the edges of the fourth portion, and wherein the first and third connecting flaps are connectable to a surface of the third portion, and the second and fourth connecting flaps are connectable to a surface of the fourth portion.

2. The open-top foldable case of claim 1, wherein the midpoint is positioned approximately midway of the length and height of the central portion.

3. The open-top foldable case of claim 1, wherein the sixth folding line extends diagonally from a top left point to an opposing bottom right point of the central portion, the top left point connecting the top edge to the left edge and the bottom right point connecting the bottom edge to the right edge.

4. The open-top foldable case of claim 1, wherein the seventh folding line extends diagonally from a top right point to an opposing bottom left point of the central portion, the top right point connecting the top edge to the right edge and the bottom left point connecting the bottom edge to the left edge.

5. The open-top foldable case of claim 1, wherein the central portion has a square shape.

6. The open-top foldable case of claim 1, wherein the first, second, third and fourth portions each has a quadrilateral shape.

7. The open-top foldable case of claim 1, wherein the sheet of material is heat-resistant paper.

8. The open-top foldable case of claim 1, wherein the first and third connecting flaps are adhered to the surface of the third portion, and the second and fourth connecting flaps are adhered to the surface of the fourth portion.

* * * * *